United States Patent [19]

Lee

[11] Patent Number: 5,040,449

[45] Date of Patent: Aug. 20, 1991

[54] SHOTGUN SHELL RELOADER

[76] Inventor: Richard J. Lee, 3146 Kettle Moraine Rd., Hartford, Wis. 53027

[21] Appl. No.: 621,069

[22] Filed: Nov. 30, 1990

[51] Int. Cl.[5] ..... F42B 33/02

[52] U.S. Cl. ..... 86/27; 86/28; 86/31; 86/33

[58] Field of Search ..... 86/25, 27, 28, 31, 33, 86/45, 46

[56] References Cited

U.S. PATENT DOCUMENTS

| | | | |
|---|---|---|---|
| 4,186,646 | 2/1980 | Martin | 86/29 |
| 4,331,063 | 5/1982 | Schaenzer | 86/36 |
| 4,418,606 | 12/1983 | Lee | 86/31 |
| 4,515,063 | 5/1985 | Lee | 86/27 |
| 4,841,831 | 6/1989 | Bender et al. | 86/27 |

*Primary Examiner*—Deborah L. Kyle
*Assistant Examiner*—J. Woodrow Eldred
*Attorney, Agent, or Firm*—Fuller, Ryan & Hohenfeldt

[57] ABSTRACT

In a shotgun shell reloader, a manually operated lever drives a carriage reciprocally on a central post for shotgun shells mounted to the carriage to engage with reloading tools arranged on a support which mounts to the upper end of the post. A circular shot plate mounts to the carriage and has a central bore for surrounding the post. An indexer member mounts in the bore of the shell plate and surrounds the post. The indexer has a helical groove in its bore which rides onto a pin extending radially from the post when the carriage is beginning to be raised so that the indexer, which is engaged with the shell plate at that time, turns the shell plate through one angular increment so that a shell on the plate will be presented to tools on the tools support successively to perform the reloading process. A powder bar and a shot bar are mounted to the top of the tool support for moving under a hopper which has chambers for powder and shot. These bars shuttle back and forth to obtain and unload charges of powder and shot into the shells. Disconnect devices are provided for prohibiting the bars from advancing to discharge powder or shot if there is no shell in the proper position on the shell plate to receive the charge. The reloader has a novel hopper valve which can shut off the flow of powder and shot to the bars.

11 Claims, 7 Drawing Sheets

SHOTGUN SHELL RELOADER

BACKGROUND OF THE INVENTION

The invention disclosed herein pertains to ammunition case reloaders generally but is illustrated and described in reference to a shotgun shell reloader.

There are existing shotgun shell reloaders which position a plurality of circumferentially arranged shells successively with circumferentially arranged tools at individual operating stations where different reloading operations are carried out at the same time on separate shells. The circumferential arrangement of shells is usually raised on a carriage for different ones of the shells to have work done on it with one of the tools at each station. The first operation is to size the shell casing which means that the shell is forced into a die which reforms the brass ring at the head of the shell into perfect circularity and into a diameter appropriate for being received in the magazine of a shotgun. The second operation is to expel the spent primer and the third is to insert a new primer. The fourth operation involves inserting the powder into the shell. The fifth operation involves inserting a wad under slight pressure so it bears on the powder. The sixth operation involves inserting shot into the shell. The seventh, eighth and ninth operations are to partially crimp, finish crimp and eject the shell from the reloading apparatus.

Most shotgun shell reloaders have a plate which is rotatable about a vertical axis and which has recesses at its periphery for accepting the head end of a shell. Because each shell must be presented for being worked on by each of the circularly arranged tools, it is necessary to index the shell support plate rotationally through an angle whose value is equal to 360° divided by the number of shells which are accommodated on the rotary shell support plate. Thus, various mechanisms have been developed for indexing the shell support plate. The indexing mechanism must rotate the shell support plate by one angular step for each movement of the carriage on which the shell plate is mounted toward or away from the circular array of reloading tools. At the end of each reloading step, the indexing mechanism steps back and places itself in readiness for indexing the shell support plate again for the next step.

Prior art indexing mechanisms have been complicated and expensive to build. It is inherent in complicated devices that wear and failures are more likely to occur. The indexing mechanism is an important feature in a shell reloader and a major contributor to the manufacturing cost of the reloader. Hence, it is important to incorporate in the reloader an indexing mechanism which is structurally simple and yet reliable.

More advanced types of shotgun shell reloaders usually have hoppers supported above them for supplying a measured portion of powder and a measured portion of metallic shot to each shell which is undergoing reloading. Some reloaders use a powder bar and a shot bar which shuttle back and forth to pick up a charge of powder, for example, from the hopper in response to the carriage on which the shell plate is mounted being moved in one direction and then moving in the opposite direction to unload the charge of powder into a spout which drops it into the shell in response to the shell support plate being moved in the opposite direction. There are times when the user of the reloader may desire to go through all of the reloading steps with a single shell before putting another shell in the shell plate. On other occasions, an empty shell may be missing from one of the positions on the support plate. Sometimes the reloader may be actuated for demonstration purposes or inadvertently under the circumstances just mentioned whereupon powder can be discharged into the space where no shell is present. The powder or the shot would then spill onto the reloader which is undesirable as is self-evident. Accordingly, it is desirable to provide means for preventing discharge of shot or powder to a station on the rotary shell support plate which contains no empty shell. A mechanism for preventing discharge of powder and shot unless there is a shell in the station on the plate should be simple in the interest of reducing cost and yet it must operate reliably.

Providing for mounting the powder and shot hopper to the reloader and removal of the hopper from the reloader without spilling powder or shot and providing means for allowing the user to perform the mounting and dismounting of the hopper with no danger of spilling powder or shot and without the need for executing any complex manipulations is extremely important.

SUMMARY OF THE INVENTION

The reloader described herein features a shell support plate indexing mechanism which essentially requires only one piece of hardware in addition to the shell plate itself. The additional hardware is a shell plate indexer, preferably molded of plastic, and comprised of a cylindrical body having a central bore in which there is a groove extending helically from one end of the cylinder to the other. There are diametrically opposite lugs extending over most of the axial length of the cylinder. The indexer cylinder, hereafter called the indexer, is mounted on a cylindrical post for being slid up and down along with a shell support plate which is mounted to a carriage which is guided on the post. There is a short pin extending radially from the post in a position such that when the indexer is raised along with the shell support plate, hereafter called the shell plate, a helical groove in the indexer is forced along the pin such as to cause the indexer to rotate through a predetermined angle which will be 45° in a case where there are eight shells accommodated in the shell plate. The indexer fits through the central bore of the shell plate and there are the equivalent of internal gear teeth disposed along the bore. When the shell plate is forced upwardly by the carriage on which it is mounted, the pin extending radially from the post impels the indexer rotationally while the lugs on the outside of the indexer are engaged at their ends inside of the notches between the teeth. Thus, the shell plate is driven rotationally through one angular increment when it is raised vertically along the central post or column of the reloader. After the shells on the plate are acted upon by the tools on the reloading tool support which is mounted on the upper end of the post, the carriage for the shell plate is lowered by manual operation of a lever at which time the indexer drags under the influence of friction between it and the post which results in the lugs withdrawing from the notches. However, the descent of the indexer now results in the helical groove in the indexer bore riding along the radially extending pin on the post so as to rotate the indexer backwards by one angular increment to realign the lugs with the notches which are one angular increment behind the notches in which the lugs were registered when the shell plate was being raised. In effect, the indexer steps back near the end of the downstroke and resets itself in the notches so that when the shell plate is raised again it will index one angular increment.

A further feature of the invention is the provision of a mechanism for disconnecting the powder bar and shot bar from being driven or shuttled so as to discharge powder or shot at a station on the shell plate which contains no shell. In accordance with the invention, when the shell plate is raised toward the tools, particularly toward the spouts for dropping powder and shot into the shells, if a shell is present, according to the invention, a disconnect device is actuated by the upwardly moving shell so as to effect a mechanical connection between a disconnect member and a rod which drives the linkage that causes the powder bar, for example, to advance to the position where it can discharge or drop its load of powder into the spout which would ordinarily direct the powder into the shell. If no shell is present at the shell plate when it is being elevated, the disconnect member is not actuated and the shell plate simply goes up without having the disconnect member actuated into driving relationship with the rod in which case the powder bar will not advance when the position on the shell plate is without a shell nor will the shot bar advance.

The new shotgun shell reloader also features a hopper which has what are effectively valves that can be closed by rotating the hopper through a few degrees so as to close the exit orifices. The hopper can then be removed from the reloader without having powder or shot leak out. In addition, the hopper is provided with a cover on which there is a pouring spout for emptying the shot and powder into their respective containers. When the cover of the hopper is in one position, it is presented to the shot chamber of the hopper so that shot may be poured from the hopper to its container. When the cover is lifted from the hopper and turned 90°, the spout is presented to the powder chamber to provide for the powder being poured from the chamber back into its container.

How the foregoing and other objectives and features of the invention are implemented will now be described in greater detail in reference to the drawings.

DESCRIPTION OF A PREFERRED EMBODIMENT

Figure 1:
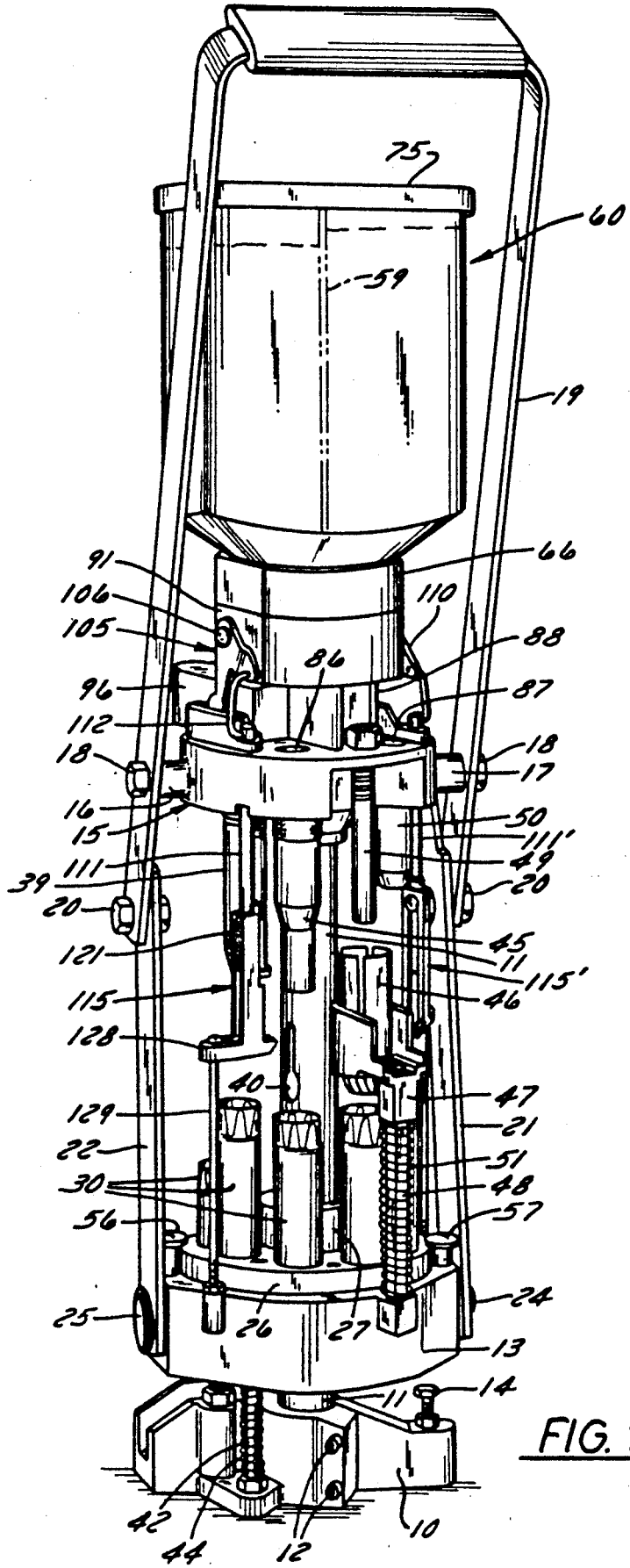
FIG. 1 is a perspective view of the new shotgun shell reloader.

Attention is invited to FIG. 1 for identification of the major parts of the reloader. The reloader comprises a base 10 in which a central cylindrical, hollow, vertical post 11 is clamped by means of socket headed screws 12. A carriage 13 is mounted for reciprocating vertically on post 11. As shown in FIG. 1, carriage 13 will stop at its lowermost position when it abuts an adjustable stop bolt 14. A reloading tool support 15 is fastened to the upper end of post 11. Tool support 15 has diametrically opposite bosses 16 and 17 extending laterally from it. Shoulder bolts such as the one marked 18 screw into boss 17, for example, and serve as pivots for a U-shaped manual operating lever 19. The lower ends of the two sides of lever 19 are pivotally connected by means of bolts, such as the one marked 20, to flat links 21 and 22. There is an indexer, generally designated by the numeral 27 in FIG. 1, extending partially out of shell plate 26 concentrically with the shell plate 26 and post 11. The structure and function of this indexer will be discussed in greater detail later since it is an important novel feature of the reloader.

Figure 7:
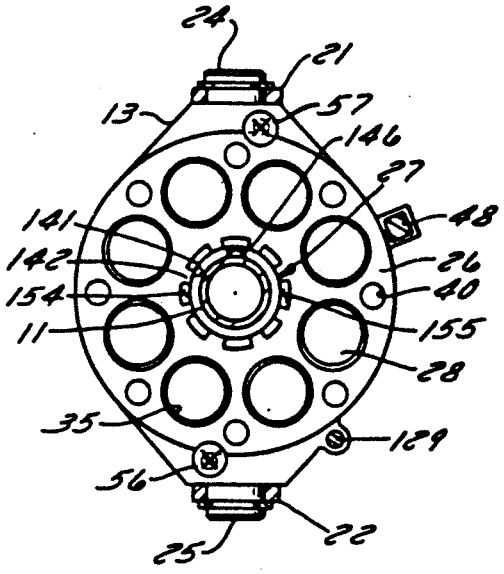
FIG. 7 is a plan view, partly in section, taken on the plane 7—7 in FIG. 5.

Shell plate 26 has eight holes 28 in the illustrated embodiment (see FIG. 7) for accommodating an equal number of empty shells which are to be reloaded. The eight holes 28 are spaced 45° apart on a common circle. Although it is not visible in FIGS. 1 or 2, there is a vertical hole through carriage 13 which is accessible from the bottom of the carriage and is for allowing shells which are candidates for being reloaded to be inserted through the hole in the casing and into the successive holes 28 in the shell plate 26.

Figure 2:
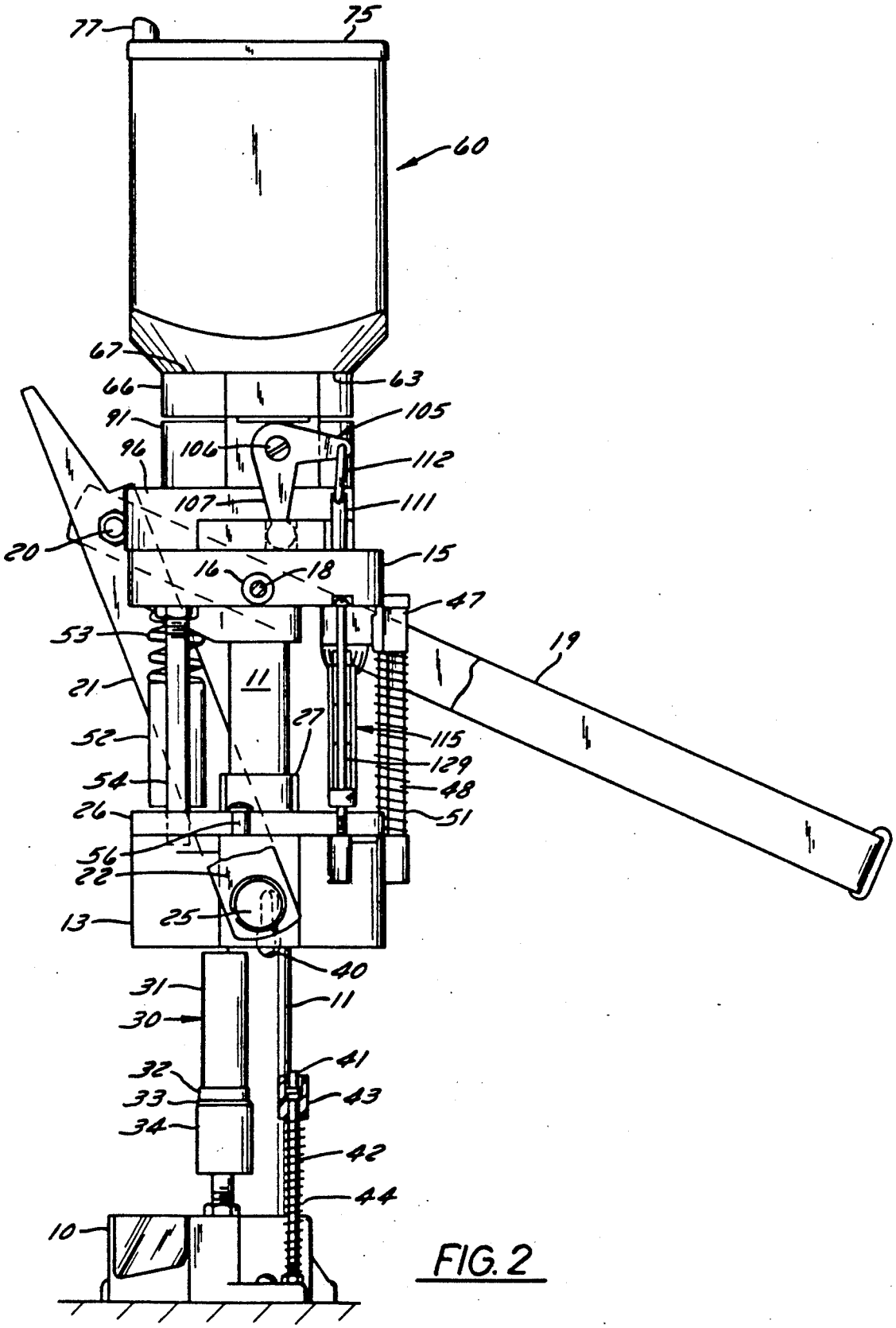
FIG. 2 is a left side elevational view of the new reloader showing the carriage for the shell plate and indexer at its uppermost position.

A shell is designated generally by the numeral 30 in FIG. 2. It comprises a plastic cylinder 31 on which there is a unitary ferrule 32 and rim 33. The shell is standing on a pedestal 34. To insert a shell 30 into one of the holes 28 in shell plate 36, the carriage 13 must be raised as it is in FIG. 2. Raising the carriage 13 to this position was accomplished by rotating manual operating lever 19 from its substantially vertical position in FIG. 1 to the position in which it is shown in FIG. 2. After that, the manual operating lever 19 is swung counterclockwise so as to lower the carriage 13 and cause shell 30 to be driven into the shell plate. In accordance with well known practice, the shell plate holes are of the proper diameter for sizing the ferrule 32 of the shell. As is evident in FIG. 7, there is a shoulder 35 in holes 28 which brings about proper shaping of the rim 33 of the shell.

Attention is invited to FIG. 1 again for a brief description of the tools that are involved in performing the sequence of reloading steps. These steps have been outlined previously, the first step, sizing of the shell, has been discussed. At the end of the sizing operation, operating handle 19 is in a vertical position as it appears in FIGS. 1 and 5. Carriage 13 is at its lower limit. The handle is then swung to the position in which it appears in FIG. 2. In the course of doing this, the new indexing mechanism which will be discussed in detail later, causes the shell plate 26 to index or rotate through one angular increment so as to place the shell in alignment with the next tool which has a vertically extending rod 39 used for punching out the spent primer in the head of the shell. The shell is driven up to rod or punch 39 for this purpose. There is a passageway, not shown, in carriage 13 which allows the spent primer to pass into an opening 40 in post 11 for falling out the bottom or open end of the post which is clamped in base 10. When the spent primer is driven out, carriage 13 is in its uppermost position as it is in FIG. 2. A new primer 41 is then set on a post 42 on which a primer holder 43 is mounted for sliding. The holder is biased upwardly by means of a spring 44. It will be evident in FIG. 2 that when operating handle 19 is swung clockwise, carriage 13 will descend and cause the shell, which has previously been indexed into alignment with the primer inserting device, to descend and have the primer plunged into it. At the end of this step, the operating handle 19 is vertical and the carriage 13 is in its lowermost position as it is in FIG. 5.

Restoring the operating handle to its FIG. 2 position and then swinging it back toward its upright position, results in the shell plate 26 being indexed rotationally one angular step which places the shell under consideration in alignment with a drop tube or spout 45 which directs powder into the shell. The novel means for prohibiting power from being discharged through spout 45 when there is no shell in alignment with the spout is an important feature of the invention and will be described in greater detail later.

Figure 5:
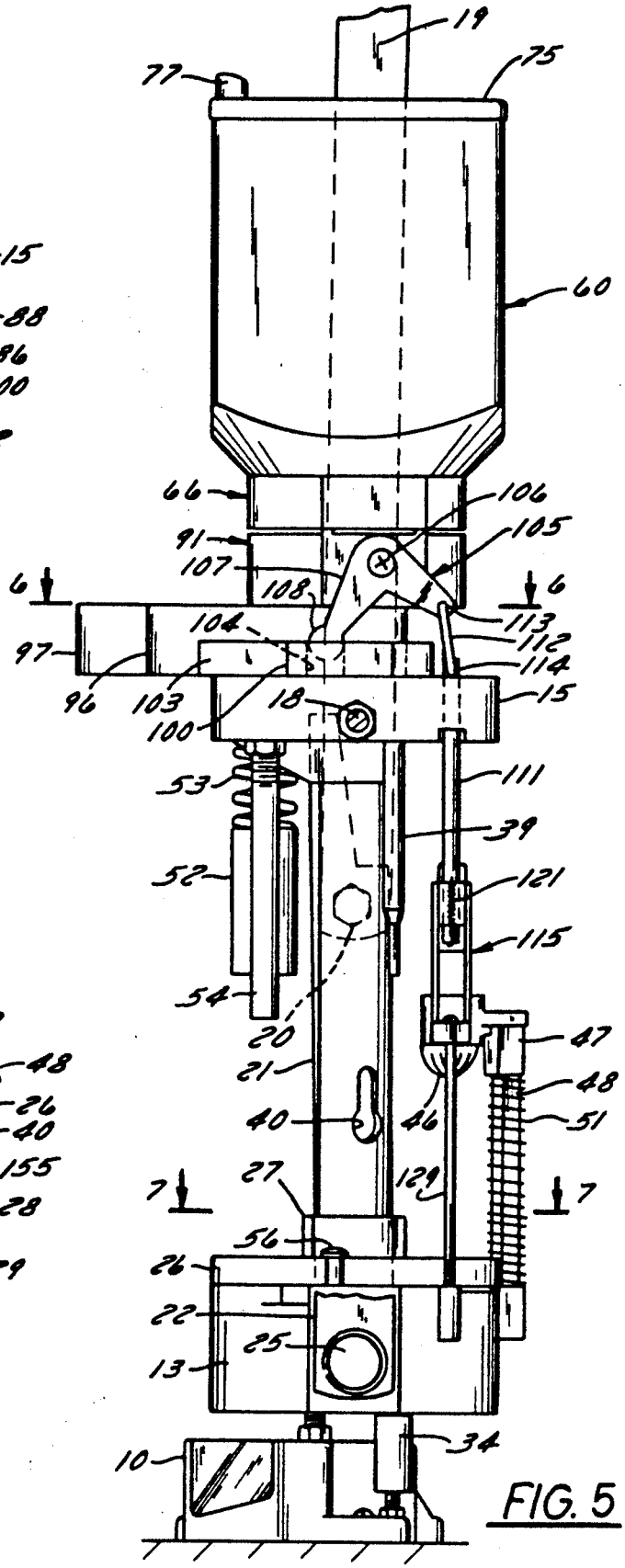
FIG. 5 is a left side elevational view of the reloader showing the disposition of the parts when the shell plate and its carriage are at the lowermost position.

Assuming that a shell has been present and a charge of powder has been inserted in the shell, handle 19 is swung to its uppermost position as in FIGS. 1 and 5 and then swung back to the position in which it appears in FIG. 2. As the handle is being swung clockwise to this position, shell plate 26 is incremented one angular step again for placing the shell in alignment with a guide and holder 46 for a wad, not shown, which separates the powder from shot which will be inserted in the shell after the wad is set. When the carriage is in its lowermost position as it is in FIG. 1, a wad is inserted in holder 46. The holder is in a bracket 47. The bracket is mounted for yielding vertically downwardly on a rod 48 in opposition to a self-restoring spring 51. When the handle is being swung down from its FIG. 1 to its FIG. 2 position, the shell plate 26 is incremented one angular step and carriage 13 is rising. Thus, the shell under consideration is aligned with wad holder 46 which, in turn, is aligned with a wad driver post 49 which is fixed on the head or tool support 15 of the apparatus. This operation punches the wad out of the holder and into the shell.

By operation of handle 19 as described, the shell is then indexed to alignment with a spout or drop tube 50 through which shot is directed into the shell. A feature of the invention is that no shot will be fed into drop tube 50 unless there is a shell in alignment with the drop tube ready to receive the shot as will be explained.

After the shot is inserted, the shell is indexed to alignment with a crimp starter which is not visible in any of the drawings but is behind post 11 in FIG. 2. The crimp starter is conventional in that it is shaped like a bell which starts the mouth of the shell to curve inwardly. The final crimping step occurs when the shell is indexed into a crimping tool which comprises a tubular cylinder 52 which is readily visible in FIG. 5. Cylinder 52 is mounted on a rod, not visible, and is resilient as a result of it being backed up by a coil spring 53. Cylinder 52 is internally configured in a conventional manner for making the final crimping step and is well known to those who are involved in designing reloading apparatus. Finally, the crimped shell is indexed to alignment with an ejector rod 54 shown in FIG. 5. When the carriage 13 raises the shell for it to be driven into rod 54, the shell is driven out of the shell plate 26 which is possible because the carriage 13 is raised at this time and there is a hole in the carriage, not shown, which allows the shell to be driven down and out by rod 54.

Note that the shell plate 26 is allowed to rotate but is retained against being removed axially from carriage 13 by the heads of two diametrically oppositely placed machine screws 56 and 57 which are screwed into the carriage 13 body.

The hopper for containing powder and shot is designated generally by the numeral 60 and is assembled to the reloader as shown in FIGS. 1, 2 and 5. Construction of the hopper is shown in greater detail in FIGS. 17–20 to which attention is now invited. In the FIG. 17 exploded view, hopper 60 is shown to be comprised of a transparent plastic material whose interior is divided by a partition wall 59 into a chamber 61 for powder and a chamber 62 for shot. The bottom of the hopper is circular and flat. The hopper has an orifice 64 for discharging powder and an orifice 65 for discharging shot. The hopper mounts to a valve member 66 which is molded of plastic. The top 67 of valve member 66 is flat for interfacing with the flat bottom surface 63 of the hopper. A screw 68 passes through a central hole 69 in the valve member 66 and screws into a threaded hole 70 in the center of the bottom 63 of the hopper. Screw 68 serves as a shaft for allowing the hopper to turn about its vertical axis on valve member 66. The top 67 of valve member 66 has a curved slot or channel 71 formed in it. There is a pin 72 extending from the bottom of the hopper. Pin 72 registers in channel 71 for limiting the angle through which the hopper may be turned relative to the hopper valve member 66. Valve member 66 is hollow except for two tubular members 73 and 74 being molded integrally with it. Tubular members 73 and 74 provide for passing powder from hopper orifice 64 and shot from hopper orifice 65, respectively, downwardly toward a shell which is undergoing reloading. When hopper 60 is rotated to an angular position on valve member 66 such that powder orifice 64 of the hopper aligns with shot powder tube 63 in the valve member and shot orifice 65 of the hopper aligns with tube 74 in the valve member, powder and shot can pass downwardly out of the hopper. When the hopper is rotated relative to the valve member 66, such that powder orifice 64 does not align with tube 73 in the valve member and shot orifice 65 does not align with tube 74 in the valve member, no powder can drop out of the hopper. Thus, since the valve member is attached to the hopper and the combination of the hopper and valve member are separable from the reloader, it is possible to remove the hopper without having any powder or shot leak out when orifices 64 and 65 are not aligned with tubes 73 and 74, respectively.

The user would oridinarily remove the hopper from the reloader when a shell reloading run is completed in which case the user may want to pour powder and shot from the hopper back into their containers, not shown. To facilitate pouring the powder from chamber 61 of the hopper and shot from chamber 62 of the hopper a special hopper cover 75 is provided. It has a downwardly extending rim 76 which provides for it to be pressed down onto the hopper to close it. Cover 75 is provided with a spout 77 contiguous with a hole 78 in the cover. If the cover 75 is fitted down onto the hopper as it is presently oriented in FIG. 17, hole 78 for the spout 77 would be aligned with the powder chamber 61 of the hopper which would allow powder to be poured out of the hopper without having shot pour out. After the powder is emptied, cover 75 is turned 90° about a vertical axis such that hole 78 for the pouring spout 77 is placed over the shot chamber 62 which allows the shot to be poured out. The simplified valve structure is an important feature of the new reloader and it offers an easy way for the user to preclude leakage of powder and shot when the hopper is being lifted off the reloader and when it is being installed on the reloader with the powder chamber 61 and the shot chamber 62 filled as it is at the outset of a reloading run.

Figure 18:
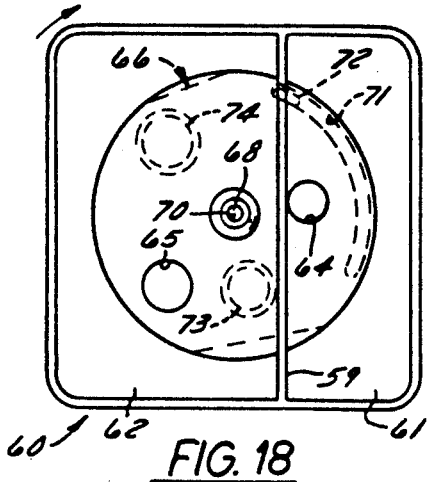
FIG. 18 is a top plan view of the hopper with the cover of the hopper removed and the hopper rotated to a position which results in the powder and shot exit orifices of the hopper powder and shot chambers being closed relative to the exit tubes in the valve member so that powder and shot will not leak out of the hopper if it were removed from the reloader.

FIG. 18 shows the hopper rotated about its vertical axis represented by screw 68 such that the pin 72 in the bottom of the hopper has come to a stop at one end of curved channel 71. This assures that bottom orifices 64 for powder and 65 for shot are blocked off by overlaying the top 67 of valve member 66.

Figure 19:
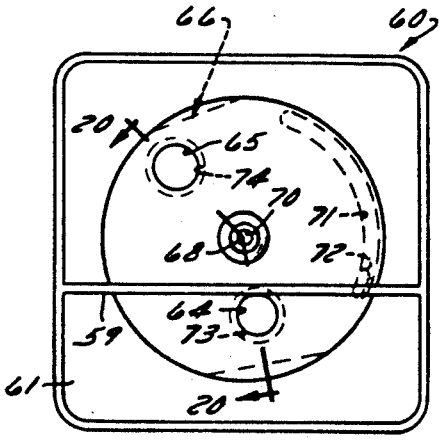
FIG. 19 shows the hopper rotated relative to the valve member such as to align the powder and shot exit orifices of the hopper chambers with the exit tubes in the valve member so that powder and shot can be acquired from their separate hopper chambers for being dropped into the shells.
Figure 20:
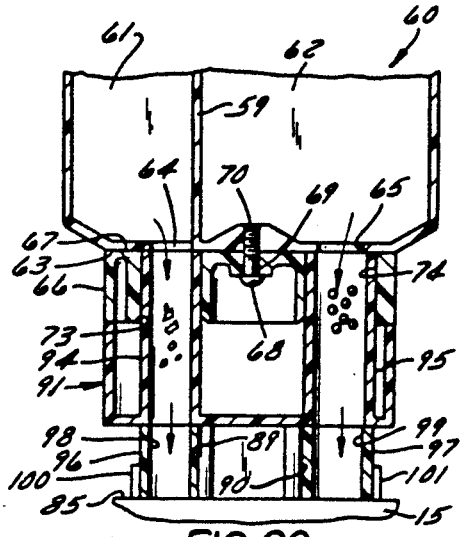
FIG. 20 is an irregular section taken on the line corresponding to 20—20 in FIG. 19.

When the hopper 60 is rotated 90° from its FIG. 18 position as is the case in FIG. 19, pin 72 comes to a stop at the opposite end of channel 71. In this case, powder orifice 64 becomes aligned with powder tube 73 in valve member 66 and shot orifice 65 becomes aligned with shot tube 74 in the valve member. In the latter case, shot and powder can be fed down from the hopper.

Figure 6:
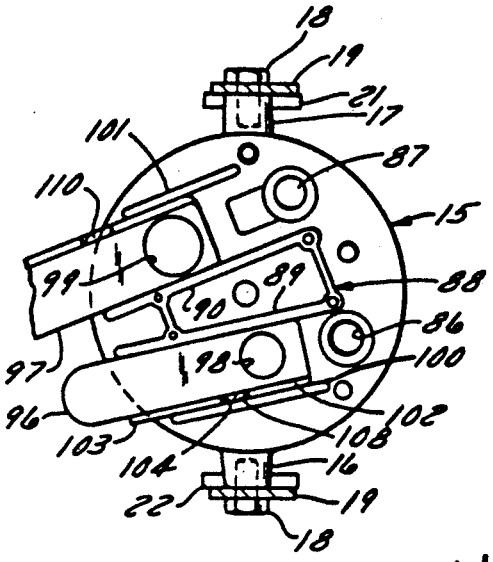
FIG. 6 is a plan view of the tool support of the reloader taken on a plane corresponding to 6—6 in FIG. 5 and showing the slidable or shuttling powder and shot bars.
Figure 15:
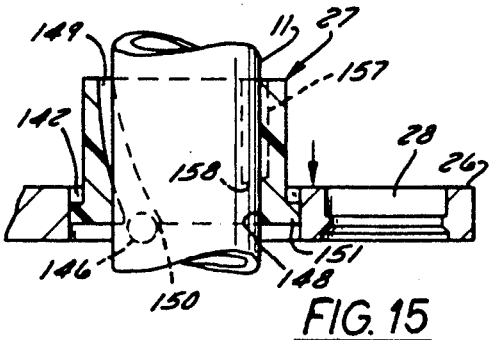
FIG. 15 shows the relationship of the parts when the shell plate and indexer are being caused to descend after having presented shells to the reloading tools on the tool carrier of the reloader.
Figure 17:
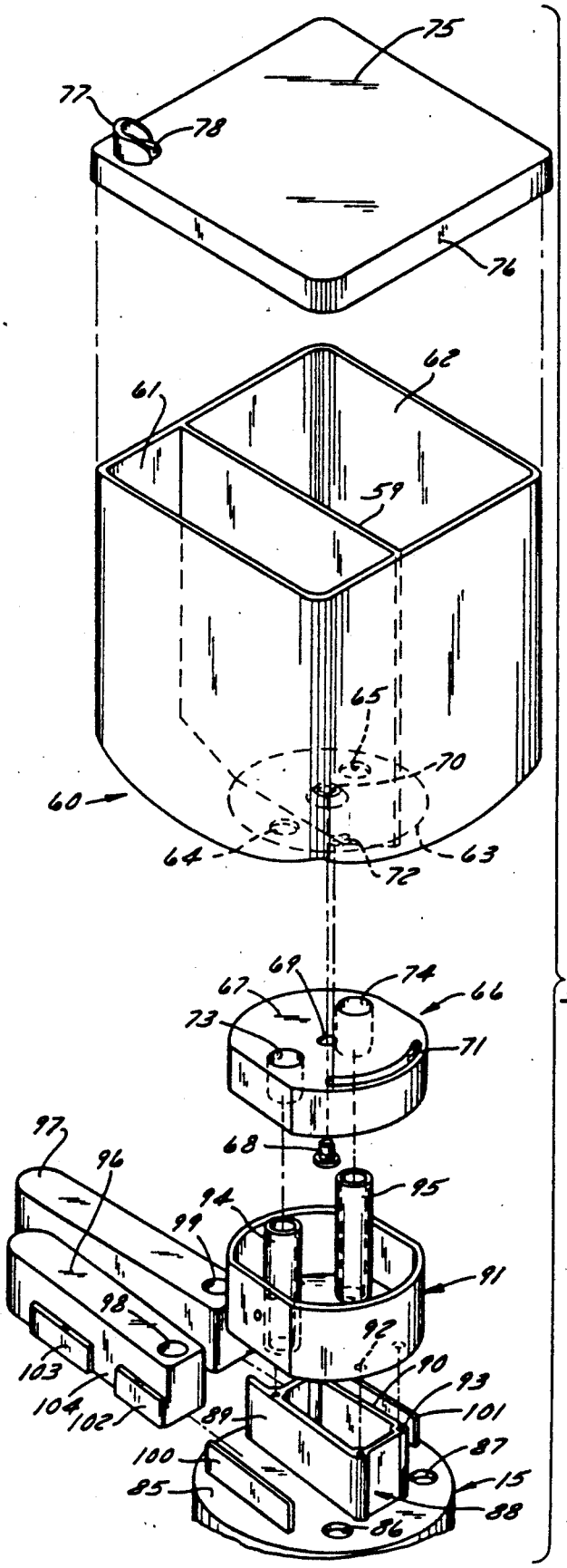
FIG. 17 is an exploded view showing the powder and shot hopper, the parts in which the hopper is mounted and the top of the tool support with the powder bar and shot bar slid off of the tool support for the sake of exposing how the top of the tool support is constructed.

Attention is directed to FIG. 17 again. Here one may see that the flat top surface 85 of the tool support 15 at the upper end of central post 11 is provided with a hole 86 for passing powder downwardly and a hole 87 for passing shot downwardly. Powder hole 86 aligns with the powder drop tube 45 which is visible in FIG. 1 and shot hole 87 aligns with shot drop tube 50 which is visible in FIG. 1. There is a four-sided frame 88 molded integrally with the top surface 85 of the tool support. As can be seen in FIGS. 6 and 17, frame 88 has side walls 89 and 90 which may be characterized as guides. An adapter or mounting base 91 for hopper valve member 66 is mounted to frame 88 by means of screws which pass through four holes such as the one marked 92 in the bottom of adapter 91 and respectively enter four threaded holes such as the one marked 93 in the corner of frame member 88. There is a powder conducting tube 94 molded integrally with the adapter and hopper valve supporting base 91 and there is also a shot conducting tube 95 molded integrally with adapter 91. There are two shuttle members one of which is called a powder bar 96 and the other is called a shot bar. The powder bar has a tube 98 constituting a powder cavity running through it for passing powder. The shot bar 97 has a tube 99 running vertically through it for passing shot. Powder bar 96 slides between advanced and retracted positions on the flat top surface 85 of the tool holder 15 between wall 89 of the frame and an upstanding guide wall 100 which is molded integrally with the metal reloading tool support 15. When powder bar 96 is retracted as it is in FIGS. 1, 3 and 5, for example, its tube 98 lines up with tube 94 in the adapter above it and a charge of powder flows into bore 98. The powder cannot flow out of bore or cavity 98 when the powder bar 96 is retracted because the bottom of the bore is closed by the top surface 85 of the tool holder. Similarly, shot bar 97 is slidable between wall 90 of frame 88 and another upstanding guide member 101. When shot bar 97 is retracted, its tube 99 lines up with tube 95 in the adapter and becomes filled with shot which has flowed through the hopper valve 66. When the shot bar 97 is advanced, its tube 99 lines up with hole 87 in tool support 15 and the shot from tube 99 flows downwardly for being passed through shot drop tube 50 which is depicted in FIG. 1. When powder bar 96 in FIG. 15 is advanced so that its tube 98 aligns with hole 86 in tube support 15, the charge of powder in tube 98 drops through hole 86 in the tube support and is conducted to a shotgun shell by powder drop tube 45 which is depicted in FIG. 1.

Powder bar 96 and shot bar 97 are rather light weight objects which are mostly hollow and molded of plastic. As can be seen in FIG. 17, powder bar 96, which is exemplary of the construction of the shot bar too, has pads 102 and 103 molded on one of its side walls. These pads are spaced apart for their ends to define between them a slot 104. When the powder bar is in its true operating position which it is not in FIG. 17, slot 104 is closed on its open side by reason of it running in sliding contact with guide 100 on the top of tool holder 15.

FIG. 6 shows how the powder bar 96 and shot bar 97 are guided for shuttling back and forth. FIG. 6 shows how powder bar 96 can slide or shuttle back and forth between guide walls 100 and 89. This figure also shows how shot bar 97 is guided for shuttling between wall 90 and guide wall 101.

Except for their size and location, the general structural features of the powder bar and shot bar are quite similar and their functions are similar except that they handle different materials. Hence, for the sake of brevity, the structure and operating characteristics of the powder bar will be described in detail sufficient for those skilled in the art to infer how to apply the same concepts to the shot bar.

Attention is now invited to FIG. 5 which shows the powder bar 96 in its fully retracted position wherein it would obtain a charge of powder which would fill its tubular cavity 98. A bell crank 105 is pivotally mounted on a shoulder screw 106 which is threaded into adapter 91. One arm 107 of the bell crank terminates in a round end 108 which fits into slot 104 on the side of the powder bar 96. It will be evident that when bell crank 105 in FIG. 5 is rocked counterclockwise through a small angle, the charge of powder in tube 98 of the powder bar will be brought into alignment with a hole 86 in the tool support 15 which allows the powder to drop down through powder drop tube 45 into a shell. A bell crank for shuttling the shot bar between retracted position wherein it loads a charge of shot to an advanced position wherein it dumps the shot into the drop tube 50 is visible in part only in FIG. 1 and is designated by the reference numeral 110. Returning attention to FIG. 5, one may see that the bell crank 105 is actuated by means of a vertically reciprocating rod 111 which is connected to the bell crank by means of a link 112 which pivotally connects to the bell crank at 113 and pivotally connects to the rod 111 at 114. Bell crank drive rod 111 not only plays a part in driving the bell crank but it also plays a part in preventing the bell crank from being driven for advancing the powder bar when no shell is in line with the drop tube 45 to receive the powder.

Figure 3:
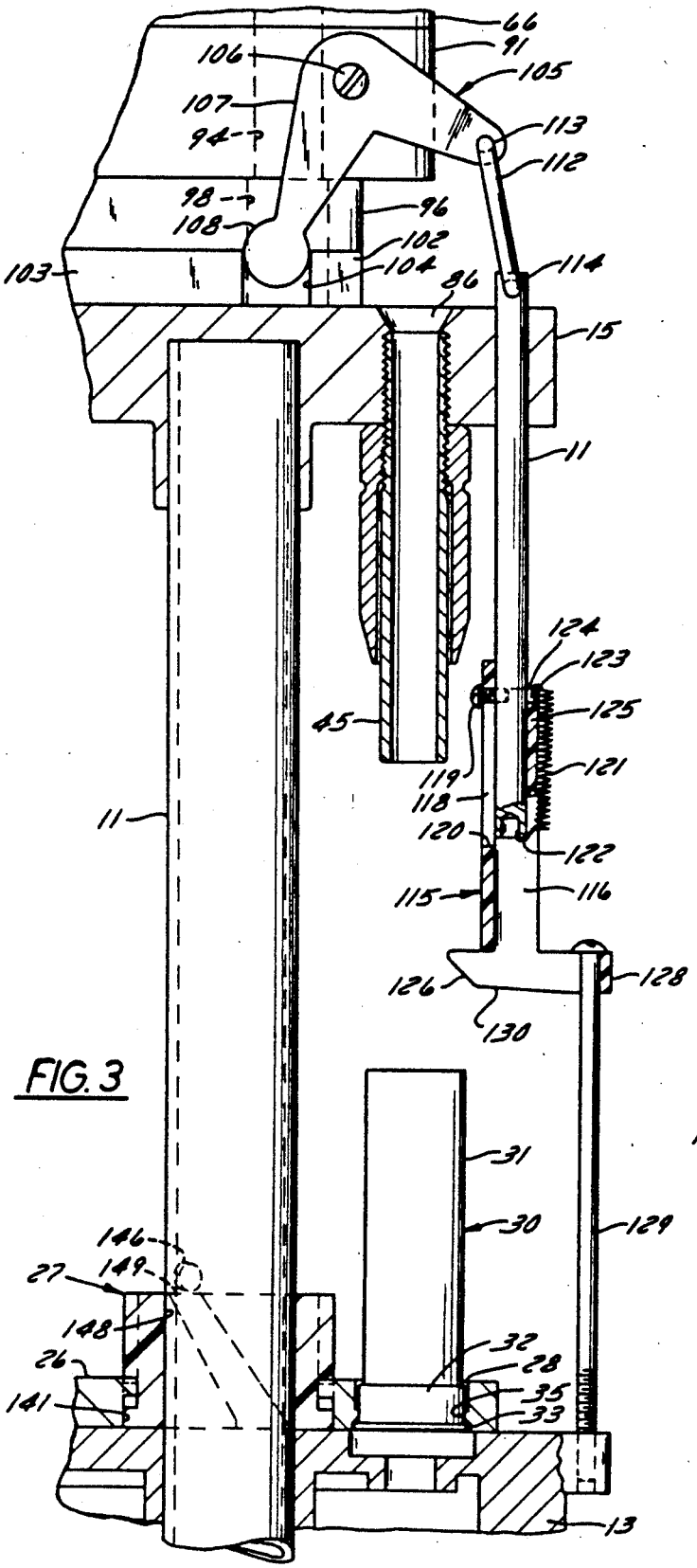
FIG. 3 shows a new mechanism for causing the powder bar to be disconnected to prevent it from advancing to a place where it could discharge powder into a station on the shell plate where a shell is missing.

The powder bar 96 drive and disconnecting mechanism is depicted in greater detail in the FIG. 3 enlargement thereof. Here it is evident that a disconnect member 115 is mounted to bell crank drive rod 111. The disconnect member is comprised of side walls 116 and 117 which have a vertically elongated opening 118 defined between them. A screw having a large head 119, which is wider than elongated opening 118, mounts the disconnect member 115 onto bell crank drive rod 111 so that the disconnect member can slide upwardly from its lowermost position to a higher position as will be explained. The lower boundary of opening 118 constitutes a stop surface 120 whose purpose will be explained. A spring 121 has its lower end hook 122 hooked into the lower end of drive rod 111 and its upper end hook 123 hooked into the upper end 124 of the back 125 of the back wall of the disconnect member. Spring 121 keeps disconnect member 115 biased vertically as it appears in FIG. 3. Under this circumstance, if disconnect member 115 is pushed upwardly as it appears in FIG. 3, there is nothing to interfere with the lower end of rod 111 passing stop surface 120 in which case the disconnect member 115 would not drive rod 111 upwardly so as to trip the bell crank 105. Hence, powder bar 96 would not be advanced from its FIG. 3 position to where it could discharge its charge of powder into opening 86 leading to powder drop tube 45.

Figure 4:
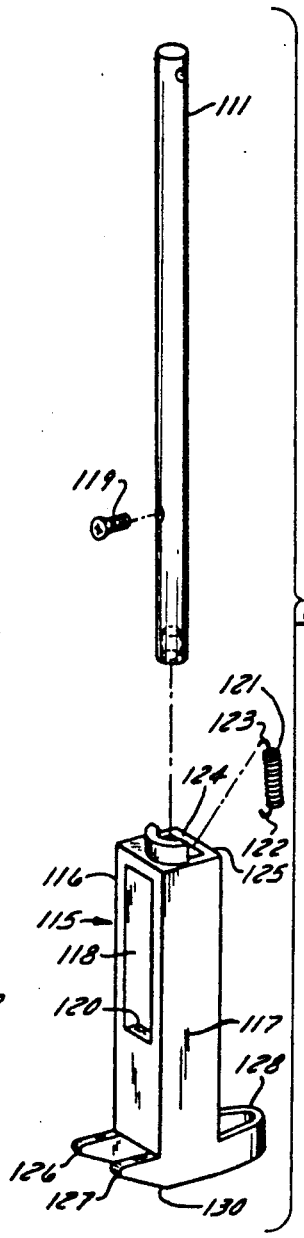
FIG. 4 is an isolated view of a disconnect member and a rod which are shown in assembled form in FIG. 3.

As shown in FIGS. 3 and 4, disconnect member 115 has a laterally extending pair of tapered prongs 126 and 127 extending integrally from it on its inside. On its rear side, there is an integrally molded loop 128. A bolt 129 is used as a guide for the loop and, hence, for the disconnect member to keep the member in a predetermined position as it is shown in FIG. 3.

Now if the operating lever 19 is actuated such as to result in carriage 13 being elevated so as to dispose shell 30 in proximity with the lower output end of powder drop tube 45 in FIG. 3 as it is in FIG. 5, shell 30 attempts to pass the beveled prongs 126 and 127 but actually deflects them to the right in FIG. 3 to overcome the bias of spring 121 which tends to keep the disconnect member 115 vertical. However, when the shell deflects the prongs 126 and 127 this makes the disconnect member 115 swing counterclockwise by a small amount about a pivot point established by screw 119 which is not screwed tightly into the disconnect member. This slight counterclockwise swing of the disconnect member aligns the stop surface 120 with the bottom end of rod 111. As the shell passes while it is being driven upwardly on carriage 123 and shell plate 126, the shell case 31 maintains the disconnect member 115 in swung position. Hence, the shell plate 26 in its upward travel eventually meets the bottom end of drive rod 111 which is now extending downwardly below the lower edge 130 of the prongs, so shell plate 26 can drive rod 111 upwardly under the influence of intervening disconnect member 115. When rod 111 is driven upwardly, it drives the bell crank 105 by way of link 112 counterclockwise such that the arm 107 of the bell crank and its round end 108 swing counterclockwise to advance the powder bar 96 so that it can drop its charge into drop tube 45. It will be evident that if there is no shell 30 in the shell plate 26 when the hole for the shell aligns with drop tube 45, disconnect member 115 will be held in vertical position by spring 121 in which case the stop surface 120 on the disconnect member will pass the lower end of rod 111 when the lower edge 130 of the disconnect member is impacted by the upwardly moving shell plate 26.

Figure 10:
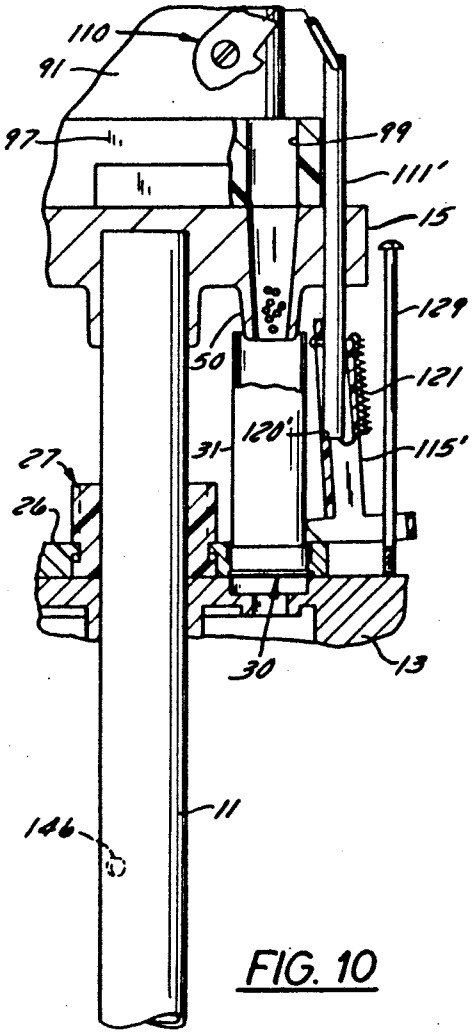
FIG. 10 depicts a situation where a shell is present in the station of the rotary shell plate which would align with the shot drop tube for receiving shot where the disconnect member is activated so that the shot bar can be advanced for discharging its charge of shot.
Figure 9:
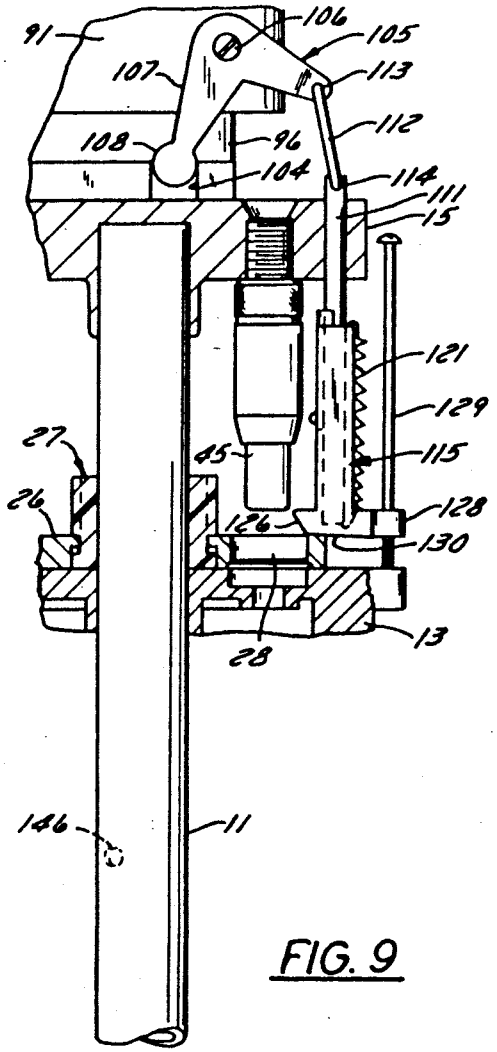
FIG. 9 shows the disposition of the parts of the safety disconnect when there is no shell in the station of the shell plate which would be aligned with the powder drop tube.
Figure 8:
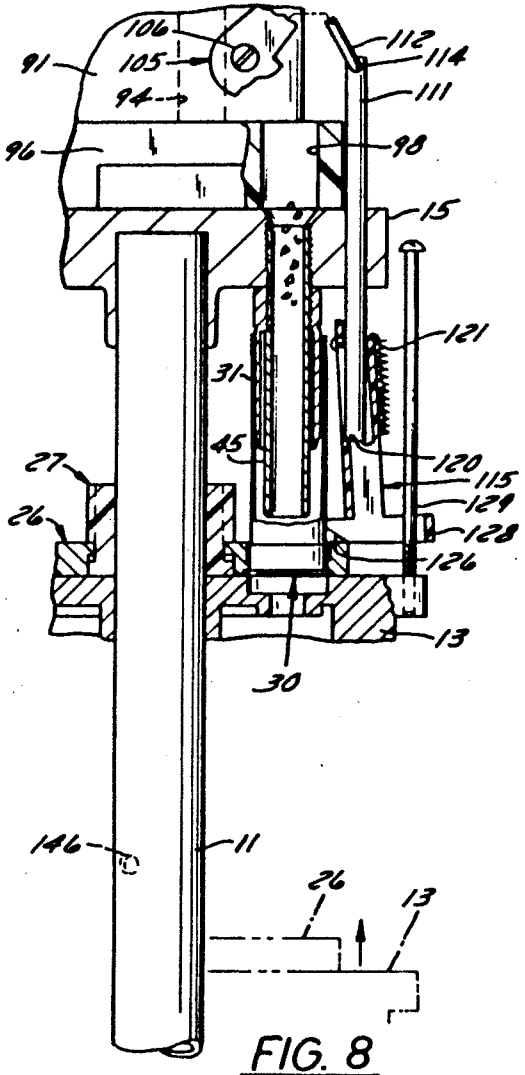
FIG. 8 shows the disposition of the parts of the safety disconnect for the shuttling powder bar in a case where there is an empty shotgun shell in the station of the shell plate which corresponds to the shell aligning with the powder drop tube for discharge of powder into the shell.

FIGS. 8, 9 and 10 show operational sequences for the safety disconnect member. In FIG. 8, a shell 31 is present when the shell in shell plate 26 is indexed to where the shell is aligned with powder drop tube 45. The shell has deflected the disconnect member 128 by striking its beveled prongs, such as the one marked 126, and the bias force of spring 121 is overcome. Consequently, the stop surface 120 on the disconnect member 115 is driven into interfering relation with rod 111 which transmits the force for driving bell crank 105 counterclockwise to advance the powder bar 96 to the position in which it is shown in FIG. 8 for dumping the charge of powder from its vertical tube 98 into the outer drop tube 45.

In FIG. 9, no shell is present in hole 28 of the shell plate 26 when the hole has arrived in alignment with powder drop tube 45 when there should be a shell in the shell plate 26. In this case, spring 121 is stretched and disconnect member 115 is driven upwardly under the influence of shell plate 26 but the disconnect member is not swung so its stop surface 120 never gets into interfering relation with rod 111 so the rod cannot be driven and the powder bar 96 remains in its retracted position as depicted in FIG. 9. Of course, as long as it is retracted, it cannot undesirably allow a charge of powder to enter drop tube 45.

FIG. 10 shows the shell 31 having been indexed with shell plate 26 for putting the shell in alignment with shot drop tube 50. In this case, the presence of shell 131 has caused deflection of disconnect member 115' and the lower end of rod 111' is in interfering relation with stop surface 120' in which case the shot bar 97 is driven by the rod actuating bell crank 110 so that the shot charge which was acquired in tube 99 when the shot bar 97 was shuttled to retracted position can be discharged into shell 31 through drop tube 50.

Another important feature of the new shotgun shell reloader design resides in its means for indexing the shell plate in fixed angular increments with only one significant part, namely, the indexer collar 27 which contributes significantly to the cost reduction and reliability aspects of the new reloader.

The indexer means will now be discussed in greater detail in reference to FIGS. 11–16 primarily.

Figure 11:
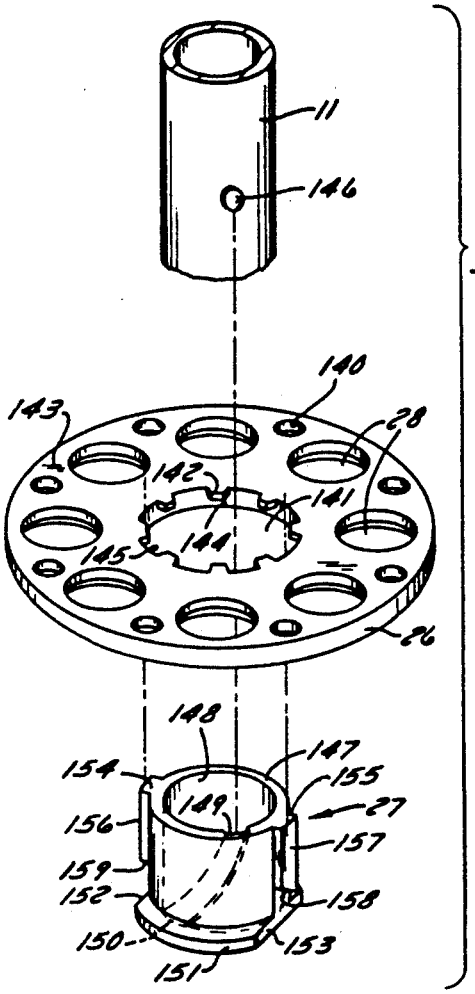
FIG. 11 depicts a fragment of the central post of the reloader, a perspective view of the shell support plate and a perspective view of the indexer.

The parts involved in indexing the shell plate 26 in equiangular steps are depicted in the FIG. 11 exploded view. It has already been mentioned in connection with FIG. 7 that the indexing plate 26 has eight holes 28 for receiving the head end of shells 31. Indexing plate 26 also has eight through holes 140 which are provided for being engaged by a spring biased ball detent, not visible, but which contributes to holding shell plate 26 positively in the position into which the plate is indexed until the plate is forcibly rotated by power derived from actuation of manual operating lever 19. The central opening 141 of the shell plate has eight radially inwardly directed teeth 142 formed in its circumference. The teeth, in this example, are 45° apart. It will be noted that the tops of the teeth 142 are flush with the top surface 143 of shell plate 26. The teeth are just a little less than one-half the thickness of the shell plate so as to provide a free space 144 between each of them. There are axially extending notches 145 defined between circumferentially spaced apart pairs of teeth 142. In the center post 11 of the shotgun shell reloader a headed pin 146 extends radially from the outer periphery of post 11.

Still referring to FIG. 11, the indexer 27 is a molded plastic article comprising a cylindrical part having a thick wall 147 and an internal bore 148. A helically extending groove is formed on the inner surface of wall 147 which defines the bore 148. The helically extending groove begins at an upper end marked 149 and terminates at a lower end 150 which is displaced circumferentially by about 45° from the other end 149. The indexer has a flange 151 formed at its lower end. The flange has opposite straight sides 152 and 153 which are molded that way but which, in a sense, are cut away from the circular part of the flange. The thickness of the flange is a little less than one-half the thickness of shell plate 26. There are drive lugs 154 and 155 formed integrally with the cylindrical part 147 of the indexer on diametrically opposite sides. The diameter distance between the axially extending surfaces 156 and 157 of the drive lugs is equal to the diameter of the flange 151. Both lower ends of the drive lugs are beveled in the same direction going around the cylinder. The beveled lower end 158 of drive lug 157 is visible in FIG. 11. The drive lugs can register in diametrically opposite notches 145 between the teeth 142 in the central bore of the shell plate 26.

Figure 12:
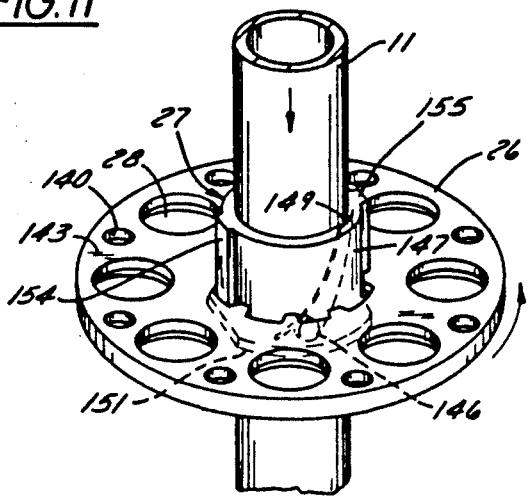
FIG. 12 shows the parts depicted in FIG. 11 in the circumstance where the indexing collar is descending on the column of the reloader and carrying the shell supporting plate downwardly with it while the collar is being compelled to rotate through one angular step by reason of the helical groove contained in its bore being compelled to follow along the stationary pin extending radially from the post.

In FIG. 12 the parts depicted in FIG. 11 are assembled. Assume that the shell plate 26 is being lifted upwardly as a result of carriage 13 on which the shell plate is mounted being lifted upwardly by operation of manual operating lever 19. If one refers back to FIG. 11, one may see that in that figure the pin 146 is directly in line with the upper end 149 of the helical groove in the indexer. In FIG. 12, it is assumed that the index plate has been rising such that the upper end 149 of the helical groove was entered by pin 146 so that as rising of the shell plate continued, the pin cammed the shell plate rotationally through one angular step in the direction of the arrow 159. At this time the lower beveled ends 158 on lug 155 and beveled end 159 on lug 154 are extending in driving relation into notches 145. It should be observed that headed pin 146 which reacts with the indexer inside of the helical groove is fixed near the lower end of the post 11 of the reloader so that all of the indexing or rotation of shell plate 26 is completed before the shell plate has risen high enough for any shell thereon to be in proximity with any of the tools on the tool support 15. Thus, any shells on shell plate 26 will be moving perfectly vertically and not rotating as they approach the tools which respectively perform a reloading step on the shelves.

Figure 13:
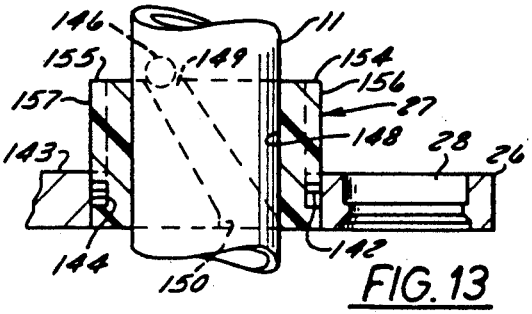
FIG. 13 shows the shell plate and the indexer as the parts would relate to each other when the indexer is in its lowermost position in the reloader and is ready to be elevated to lift empty shells towards the reloading tools of the reloader.

Operation of the indexer will now be elaborated in reference to FIGS. 13–16. In these figures, it is assumed that the shell plate 26 is mounted on carrier 13 as shown in several figures but is omitted in the interests of space conservation. Referring to FIG. 13, it is assumed that the carriage 13 is stopped in its lowermost position and so is shell plate 26 in its lowermost position. Pin 146 is presently aligned with the upper end 149 of the helical groove in the bore 148 of the indexer. The lowered beveled ends 158 and 159 of lugs 155 and 154, respectively, can be extending down into the notches 145 between teeth 147. Incidentally, note that the parts in FIGS. 13–16 are drawn from the back side relative to FIGS. 11 and 12. Actually, indexer 149 rotates about 50°.

Figure 14:
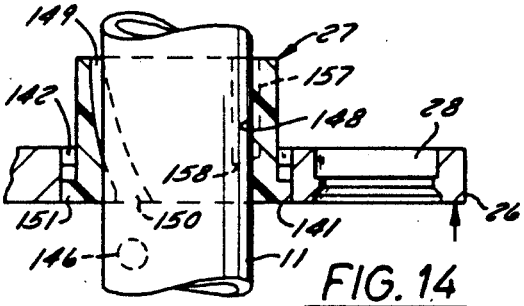
FIG. 14 shows the indexer and shell plate rotated one angular step in the course of the shell plate being lifted towards its uppermost limit.

FIG. 14 shows the situation where shell plate 126 has been elevated with the upwardly moving carriage 13 sufficiently for the upper end 149 of the helical groove 149 to have passed onto headed pin 146 and so that continued upward force of the shell plate causes the helical groove to pass over the pin 146 so that the lower end 150 of the helical groove eventually passes beyond the stationary pin 146. As explained previously, when the helical groove is sliding over pin 146 it necessarily compels the indexer 27 to rotate one angular step. Rotation in this case of the shell plate 26 is in the counterclockwise direction when viewing the shell plate from the top in any one of the FIGS. 13–16. In FIG. 14, the beveled lower ends, such as the lower end 159 of lug 154 simply ride over the smooth top surfaces of teeth 142. As previously indicated, when the indexer 27 has passed headed pin 146 the shell plate 26 continues to move straight upwardly without rotation on indexer 27. In FIG. 15 it is assumed that any shell which might have been in hole 28 of shell plate 26 has been operated on by a tool and that the carriage with the shell plate 26 should be lowered by operating the manual handle 19 into vertical position as it is depicted in FIG. 1. In FIG.

Figure 16:
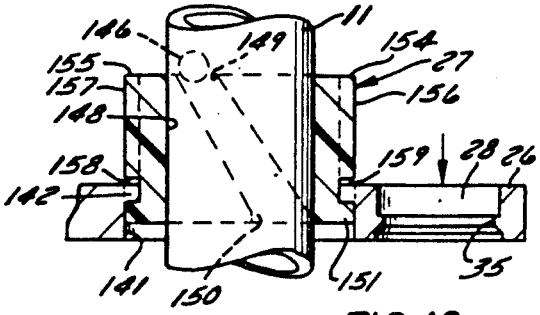
FIG. 16 shows the relationship of the indexer collar shell plate and pin in the reloader column when the indexer collar is just about completely reset for executing another rotational step.

15 descent of the indexer 27 is sufficient for the lower end 150 of the helical groove to start sliding over pin 146 which results in the indexer starting to rotate in a clockwise direction as viewed from its top in FIG. 15 and to continue to rotate until the upper end 149 of the helical groove has descended to where about one-half of pin 146 is still in the groove to preclude the groove and pin from ever becoming misaligned as is the situation existing in FIG. 13 which is comparable to the situation in FIG. 16. What actually happens is the indexer 27 hangs up slightly near the end on its way down as a result of friction between the post 11 and the indexer 27 and as a result of the upward component of force exerted on the indexer as the helical groove of the indexer is descending on pin 146. What actually happens is the beveled lower ends of the lugs 154 and 155 slide reversely over teeth 142 and drop into the notches 145 between teeth 142 when the shell plate 126 is being pushed upwardly as in FIG. 14. In FIG. 15, when the shell plate is descending, the lower ends 158 and 159 of the lugs 154 and 155 still extend, at the beginning of the downstroke at least, into the spaces or notches 145 between the teeth 142 of the shell plate 26. The added friction, however, resulting from the helical slot running on pin 146 causes the indexer 127 to lift sufficiently far for the lower beveled ends 158 and 159 of the lugs to lift out of the slots 145. The hangup of the indexer thereby lets the beveled ends ride over the teeth and take one step backwards among the teeth to the next preceding diametrically opposite notches. The beveled ends then drop into diametrically opposite notches 145 just as the indexer is separating from pin 146. Thus, the upper end 149 of the helical groove remains aligned with headed pin 146 as in FIG. 16 in readiness for causing the indexer to rotate clockwise as viewed from the top in FIG. 16. When the shell plate 26 in FIG. 16 is started upwardly again, lugs 154 and 155 are engaged with the shell plate by reason of the lugs having dropped into the spaces or slots 145 between the teeth 142 of the shell plate to cause rotation of the shell plate in conjunction with the driving force developed as a result of the interaction between the helical groove 149 and headed pin 146.

It should be understood that indexers can be used in pistol and rifle ammunition case reloader apparatus as well as in shotgun shell reloaders and that the broad concepts expressed in the claims are meant to embrace pistol and rifle ammunition case reloaders.

I claim:

1. A shotgun shell reloader comprising:

a post having upper and lower ends, a base on which the lower end of the post is supported and a reloading tool support member mounted to the upper end of the post, a plurality of downwardly extending reloading tools mounted to the tool support member and arranged in a circle around said post in equiangular spaced relationship, a carriage mounted on said post and means for alternately raising said carriage toward said reloading tools and lowering said carriage toward said base, a generally planar shell holder plate having a central opening for fitting on said post and having a plurality of holes for holding shells which are to be reloaded, said holes being arranged in a circle around the post in equiangular spaced relationship and said shell holder plate being mounted to said carriage for rotating around the post, a plurality of teeth formed in said shell holder plate around said central opening, said teeth being equiangularly arranged around said opening and extending radially inwardly of the opening for defining between the teeth a corresponding plurality of equiangularly spaced apart notches, the axial thickness of said teeth being less than the thickness of said shell holder plate, an indexer comprised of a generally cylindrical body having axially spaced apart nominally upper and lower ends and an axially extending central bore providing for mounting said body concentrically to said post inside of said central opening in the shell holder plate, said body having a generally helical groove extending generally axially along said bore over the whole length of the body between said upper and lower ends of said body and lug means extending axially along said body and having beveled lower ends, shoulder means constituting a stop means formed integrally with said body at its said lower end and extending radially outwardly of the body, said shoulder means having a thickness less than the thickness of said shell holder plate for fitting into said central opening of said plate beneath said teeth in the opening, pin means projecting radially outwardly from said post above said shell holder plate on said carriage when said carriage is in its lowermost position on said post, raising of said carriage and shell holder plate from said lowermost position toward said tool support member causing said generally helical groove in the indexer body to run over said pin means and force said body to rotate in one direction through one predetermined angular step concurrently with said lug means on said body engaging in said equiangularly spaced notches for driving said shell holder plate rotationally through an angular step, lowering of said carriage on said post from above said pin means causing said substantially helical groove in said body to run over said pin means again to rotate said body of the indexer oppositely of said one direction while frictional drag between said lowering body and post allows said beveled ends of the lugs to disengage from said notches and rotate into engagement with notches one angular step from the notches from which the lugs disengaged.

2. The reloader according to claim 1 wherein said indexer is composed of plastic material and said shell plate is metal.

3. The reloader according to claim 1 including:

hopper means mounted above said tool support member and having individual powder and shot discharge orifices, a powder bar arranged for translating on said tool support member between a retracted position wherein said bar receives a quantity of powder from said powder discharge orifice and an advanced position wherein said bar is positioned for dropping said quantity of powder into a shell, rod means having an upper portion positioned above said tool support member and a lower portion positioned below said tool support member, said rod means being mounted for moving up and down relative to said tool support member, means for coupling said rod means at its upper portion to said powder bar to drive said powder bar to said advanced position in response to said rod means moving up and for holding said powder bar in retracted position in response to said rod means remaining down, a disconnect member and pivot means connecting said disconnect member to said rod means for swinging through an angle relative to said rod means and for sliding along said rod means, said disconnect member having a stop surface thereon swingable with said disconnect member between first and second angular positions, raising said carriage toward said tool support when there is a shell in a position on said shell plate to receive powder resulting in said shell causing said disconnect member to swing from said first angular position to said second angular position wherein said stop surface is positioned in interfering relation with said rod means so that the upwardly moving carriage forces said disconnect member and rod means upwardly for driving said powder bar to said advanced position for discharging powder into said shell, raising said carriage when there is no shell in a position on said shell plate to receive powder resulting in said disconnect member remaining in said first angular position with said stop surface in non-interfering position such that when said upwardly moving carriage encounters said disconnect member said member only slides on said rod means without raising the rod means so said powder bar remains in retracted position.

4. The reloader according to claim 1 including:

hopper means mounted above said tool support member and having individual powder and shot discharge orifices, a shot bar arranged for translating on said tool support member between a retracted position wherein said bar receives a quantity of shot from said shot discharge orifice and an advanced position wherein said bar is positioned for dropping said quantity of shot into a shell, rod means having an upper portion positioned above said tool support member and a lower portion positioned below said tool support member, said rod means being mounted for moving up and down relative to said tool support member, means for coupling said rod means at its upper portion to said shot bar to drive said shot bar to said advanced position in response to said rod means moving up and for holding said shot bar in retracted position in response to said rod means remaining down, a disconnect member and pivot means connecting said disconnect member to said rod means for swinging through an angle relative to said rod means and for sliding along said rod means, said disconnect member having a stop surface thereon swingable with said disconnect member between first and second angular positions, raising said carriage toward said tool support when there is a shell in a position on said shell plate to receive shot resulting in said shell causing said disconnect member to swing from said first angular position to said second angular position wherein said stop surface is positioned in interfering relation with said rod means so that the upwardly moving carriage forces said disconnect member and rod means upwardly for driving said shot bar to said advanced position for discharging shot into said shell, raising said carriage when there is no shell in a position on said shell plate to receive shot resulting in said disconnect member remaining in said first angular position with said stop surface in non-interfering position such that when said upwardly moving carriage encounters said disconnect member said member only slides on said rod means without raising the rod means so said shot bar remains in retracted position.

5. The shotgun shell reloader according to claim 1 including:

a hopper for being mounted above said tool support member and wall means in the hopper for partitioning the hopper into a powder chamber for storing powder and a shot chamber for storing shot, said hopper having a bottom containing a powder discharge orifice for the powder chamber and a shot discharge orifice for the shot discharge chamber, a base comprising a valve member and means connecting said bottom of the hopper to said valve member for said hopper to rotate on said valve member about a vertical axis, said valve member having a powder passageway for conducting powder and a shot passageway for conducting shot, said passageways being radially spaced from said axis in correspondence with said powder and shot orifices, respectively, said hopper being rotatable about said axis relative to said valve member to one position for aligning said powder discharge orifice with said powder passageway and aligning said shot discharge orifice with said shot passageway to allow powder and shot to be conducted from the respective chambers, said hopper being rotatable to positions wherein said orifices and passageways are not aligned to prevent powder and shot from discharging from said chambers, respectively.

6. A shotgun shell reloader comprising:

a base and an upright post having a lower end mounted to said base and a reloading tool support member mounted to an upper end of the post with reloading tools projecting downwardly from the tool support member, a carriage adapted for moving on said post alternately upwardly toward said tool support and downwardly toward said base, and means for moving the carriage, a shell holder mounted on said carriage for being rotated about said post for positioning a shell on said holder successively at a station for having powder dropped into said shell and in alignment with a station for having shot dropped into said shell when said shell holder has been moved upwardly with said carriage, a powder bar and a shot bar mounted for moving generally horizontally, respectively, on said tool support member between retracted positions wherein a cavity in the respective bars is filled with powder and shot, and advanced positions for discharging the powder and shot from the cavities at the respective stations, a powder bar drive rod and a shot bar drive rod mounted for sliding up and down, said rods having upper end portions and lower end portions, means for mechanically coupling said upper end portions of the rods, respectively, to said powder bar and shot bar such that when the rod is down said bars are maintained in retracted position and when the respective rods are driven up said powder bar and shot bar are moved to said advanced position to discharge powder or shot if a shell is present at the station on said shell holder, disconnect members operative to prevent said rods from being driven upwardly to advance a bar if there is no shell in proper position on said shell holder for receiving powder or shot when said shell holder is moved up with said carriage, said disconnect member being engaged by said carriage for driving said rod upwardly when there is a shell in proper position, means for mounting said disconnect members on the lower end portions of the respective rods for swinging through an angle relative to the rods and for sliding on the rods, a stop surface on said disconnect members which passes the lower end portions of said rods when said disconnect members are not swung when the upwardly moving carriage encounters said disconnect members so the rods are not driven up and neither the powder bar nor shot bar is moved to advanced position for discharging power or shot, a shell on said upwardly moving carriage striking and swinging said disconnect member to cause said stop surface to move to driving relation with said rods for advancing the bars to discharge powder and shot in the shell.

7. a shell reloader comprising:

a support member and a plurality of shell reloading tools mounted to said support member, a powder bar mounted for translating generally horizontally above said support member between a retracted position wherein a cavity in said powder bar is filled with powder and an advanced position wherein the powder is discharged from the cavity to a shell, a shot bar mounted for translating generally horizontally above said support between a retracted position wherein a cavity in said shot bar is filled with shot and an advanced position wherein the shot is discharged from the cavity to a shell, a hopper assembly mounted above said bars including a hopper and a wall for partitioning said hopper into a powder chamber and a shot chamber, said hopper having a substantially flat bottom area extending across at least part of said powder and shot chambers, the powder and shot chambers having discharge orifices for powder and for shot in said bottom, a valve member having a substantially flat top arranged to interface with the bottom of said hopper, and means fastening said top of the valve member to the bottom of the hopper to provide for relative rotation between said hopper and valve member about an axis, said valve member having a passageway for powder and passageway for shot radially spaced from said axis, and said orifices for powder and for shot being similarly radially spaced to provide for discharge of powder and shot from said chambers when said hopper and valve member are rotated relative to each other to simultaneously align said orifices with said passageways in the valve member and provide for preventing discharge of powder and shot when said hopper and valve member are rotated relatively for said orifices to be out of alignment with the passageways.

8. The reloader according to claim 7 wherein:

said hopper has four vertical walls arranged in a square defining a top opening, a correspondingly square cover having four corners and fitting onto said hopper over the opening, said cover having an aperture at one of the corners, placing the cover on the hopper with the aperture over the powder chamber allowing powder to be poured out of the powder chamber while preventing shot from spilling from the shot chamber, and turning the cover to place the aperture over the shot chamber allowing shot to be poured out while preventing powder from spilling from the powder chamber.

9. The hopper according to claim 8 including a pouring spout formed integrally with the hopper cover adjacent said aperture.

10. A shotgun shell reloader comprising:

a base, an upright post having a lower end mounted to the base and an upper end extending remotely from the base, a support member, having top and bottom sides, mounted to said upper end of the post, a plurality of reloading tools at reloading operation stations in equiangular relationship around said post and projecting downwardly from said bottom side of said support member, a carriage mounted to said post for reciprocating upwardly and downwardly, manually operated means for reciprocating the carriage, a shell holder plate mounted on said carriage for rotating about said post and having a plurality of holes for receiving shotgun shells with their axes vertical, said holes being equiangularly arranged in a circle around said post correspondingly with the angle between said tools, chambers for powder and shot, respectively, mounted over said support members, said chambers having an orifice for discharging, respectively, powder and shot under the influence of gravity, powder bar means and shot bar means individually drivable at angularly separated stations over said support member between retracted positions wherein a cavity in each bar means fills with powder and shot, respectively, from said chambers and advanced positions wherein said powder and shot are positioned for being dropped from the cavity of the bar through a hole in said support member into a shell, an individual vertically extending rod means associated with each bar means for driving each of the bar means, each of the rod means be mounted to said support member for being raised and lowered, and a mechanism for connecting the rod means above said support means to said powder bar means and said shot bar means, respectively, for driving said bar means to retracted position when the associated rod is lowered and to advanced position when the associated rod is raised, a disconnect member mounted to each rod means below said support member for being swung about a horizontal axis between first and second angular positions by a shell being raised on said carriage to receive a charge of powder and a charge of shot, said disconnect members, respectively, having stop means thereon which is moved into driving relationship with said rod means when said disconnect member is swung to said second angular position so that when said carriage encounters said disconnect member the rod is raised to advance the associated bar means for dropping a charge in said shell, and means for biasing said disconnect member to said first angular position for preventing said rod means for being driven by said carriage and preventing either of said bar means from being advanced to discharge powder or shot when no shell is present on the carriage corresponding to the powder or shot charging stations.

11. An ammunition case reloader comprising:

a first member having a case holder plate mounted thereon for rotating about a vertical axis, said case holder having means for supporting a plurality of ammunition cases in circular arrangement about said axis, a second member for supporting a plurality of case reloading tools arranged in a circle about said vertical axis, means for moving one of the members up to and down and away from the other members for the reloading tools to perform reloading operations on the cases when the tools and cases are proximate to each other, said case holder having a central opening, a plurality of teeth formed in said case holder plate around said central opening, said teeth being equiangularly arranged around said opening and extending radially inwardly of the opening for defining between the teeth a corresponding plurality of equiangularly spaced apart notches, the axial thickness of said teeth being less than the thickness of said case holder plate in the margin around the opening, an indexer comprised of a generally cylindrical body for fitting into said central opening and having axially spaced apart nominally upper and lower ends and an axially extending central bore, said body having a generally helical groove extending generally axially along said bore over the whole length of the body between said upper and lower ends of said body and lug means extending axially along said body and having beveled lower ends, shoulder means constituting a stop means formed integrally with said body at its said lower end and extending radially outwardly of the body, said shoulder means having a thickness less than the thickness of said case holder plate for fitting into said central opening of said plate beneath said teeth in the opening, pin means fixedly supported between said first and second members for aligning with said helical groove, pin means projecting radially outwardly from said post above said shell holder plate on said carriage when said carriage is in its lowermost position on said post, moving of said case holder plate with said first member upwardly toward said tool support second member causing said generally helical groove in the indexer body to run over said pin means and force said body to rotate in one direction through one predetermined angular step concurrently with said lug means on said body engaging in said equiangularly spaced notches for driving said case holder plate rotationally through an angular step, moving said first member downwardly causing said substantially helical groove in said body to run over said pin means again to rotate said body of the indexer oppositely of said one direction for said beveled ends of the lugs to disengage from said notches and rotate into engagement with notches one angular step from the notches from which the lugs disengaged.

* * * * *